US006823618B2

(12) United States Patent
Huang

(10) Patent No.: US 6,823,618 B2
(45) Date of Patent: Nov. 30, 2004

(54) ADVERTISEMENT LIGHT BOX

(76) Inventor: Shen Yu Huang, C/ PMB#1008, 1867 Ygnacio Valley Rd., Walnut Creek, CA (US) 94598-3214

( * ) Notice: Subject to any disclaimer, the term of this patent is extended or adjusted under 35 U.S.C. 154(b) by 0 days.

(21) Appl. No.: 10/340,738

(22) Filed: Jan. 13, 2003

(65) Prior Publication Data

US 2003/0136037 A1 Jul. 24, 2003

(30) Foreign Application Priority Data

Jan. 18, 2002 (TW) ..... 91200396 U

(51) Int. Cl.[7] ..... G09F 13/04
(52) U.S. Cl. ..... 40/575
(58) Field of Search ..... 40/546, 575; 362/125, 362/812

(56) References Cited

U.S. PATENT DOCUMENTS 5,174,056 A * 12/1992 King ..... 40/574
5,335,100 A * 8/1994 Obata ..... 349/65
5,676,444 A * 10/1997 Liao ..... 362/31
5,678,334 A * 10/1997 Schoniger ..... 40/546
5,997,148 A * 12/1999 Ohkawa ..... 362/31
6,530,164 B2 * 3/2003 Gai ..... 40/546
6,669,092 B2 * 12/2003 Leanheart et al. ..... 235/462.13

* cited by examiner

*Primary Examiner*—Andrew D. Wright
(74) *Attorney, Agent, or Firm*—Leong C. Lei

(57) ABSTRACT

An advertisement light box is disclosed. The light box comprises a main frame, a panel, a light guiding structure, a light guiding source positioning device. The inner side of the panel is provided with a locking hole and the four sides of the panel can be lifted or the entire panel can be lifted by means of the fastening of connection plate, and the light box is provided with a clip for easy mounting of an advertisement material, and the four lateral sides of the light guiding structure are provided with a light guiding source fastener which is an inverted U-shaped board directly mounted to the edge of the light guiding structure so as to prevent the light guiding board to deform or to prevent the light to leak, the interior of the inverted U-shaped board is provided with light tubes, and the inner wall of the U-shaped board is coated with a silver or the like material to provide good reflection of light.

1 Claim, 9 Drawing Sheets

ADVERTISEMENT LIGHT BOX

BACKGROUND OF THE INVENTION (a) Technical Field of the Invention

The present invention relates to an improved structure of an advertisement light box, and in particular, a box having frame at the sides thereof which can be lifted up when necessary. The advertising panel of the box can be easily dismantled and assembled if needed, and a guiding light source positioning device with the functions of positioning, light focusing, light reflecting is provided to the box.

(b) Description of the Prior Art

Conventional advertisement light box contains a transformer, a starter, tubes and wires, etc. These components are normally mounted at the rear panel of the advertisement light box and the advertising panel of the light box is mounted at the front side of the box and is commonly fabricated from acrylic material. The installation of these components onto the advertisement light box is laborious and some components such as the transformer, starter tube, etc generate a large amount of heat. In addition, the thickness of the frame has to be at least 200 mm, otherwise, the tubes within the advertisement box is visible.

Taiwanese Patent No. 153860, entitled "An improvement on the fixing of advertising slide within a light box", and No. 157502 entitled "An improvement of an advertisement light box", disclose a light box structure which can be optionally opened or closed at the advertising panel of the light box. The acrylic light guiding board will be deformed after a period of time. Besides the light source for the conventional advertisement light box is a common lighting tube mounted at the two lateral sides of the light guiding board. However, this tube is covered with aluminum foil and therefore the effect of reflection is poor. Further, if the lighting tube is to be replaced, it is very laborious. Therefore, an improved advertisement light box is disclosed so as to overcome the drawbacks mentioned above.

SUMMARY OF THE INVENTION

Accordingly, it is an object of the present invention to provide an improved advertisement light box having a main frame with guiding slot at the four lateral sides thereof, a panel, a light guiding structure characterized in that the inner side of the panel is provided with a locking hole and the four sides of the panel can be lifted or the entire panel can be lifted by means of the fastening of connection plate, and the light box is provided with a clip for easy mounting of an advertisement material, and the four lateral sides of the light guiding structure are provided with a light guiding source fastener which is an inverted U-shaped board directly mounted to the edge of the light guiding structure so as to prevent the light guiding board to deform or to prevent the light to leak, the interior of the inverted U-shaped board is provided with light tubes, and the inner wall of the U-shaped board is coated with a silver or the like material to provide good reflection of light.

Yet a further object of the present invention is to provide an improved structure of advertisement light box, wherein the connection plate is a L-shaped structure.

Still another object of the present invention is to provide an improved structure of an advertisement light box, wherein the clip having a clipping body which is mounted with an elastic body.

A further object of the present invention is to provide an improved structure of an advertisement light box, wherein the light tube is a cold cathode light tube.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
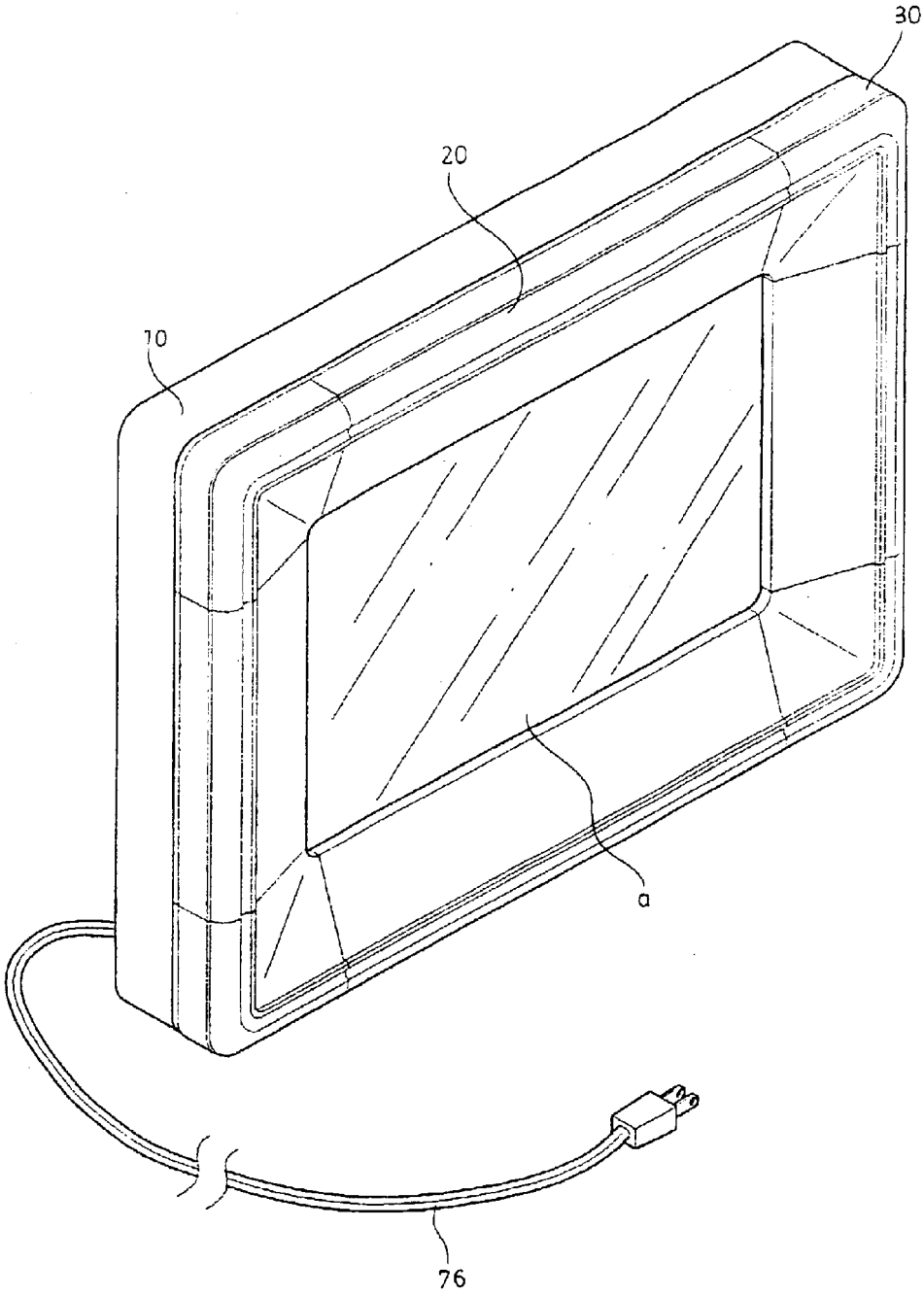
FIG. 1 is a perspective view of the advertisement light box of the present invention.
Figure 2:
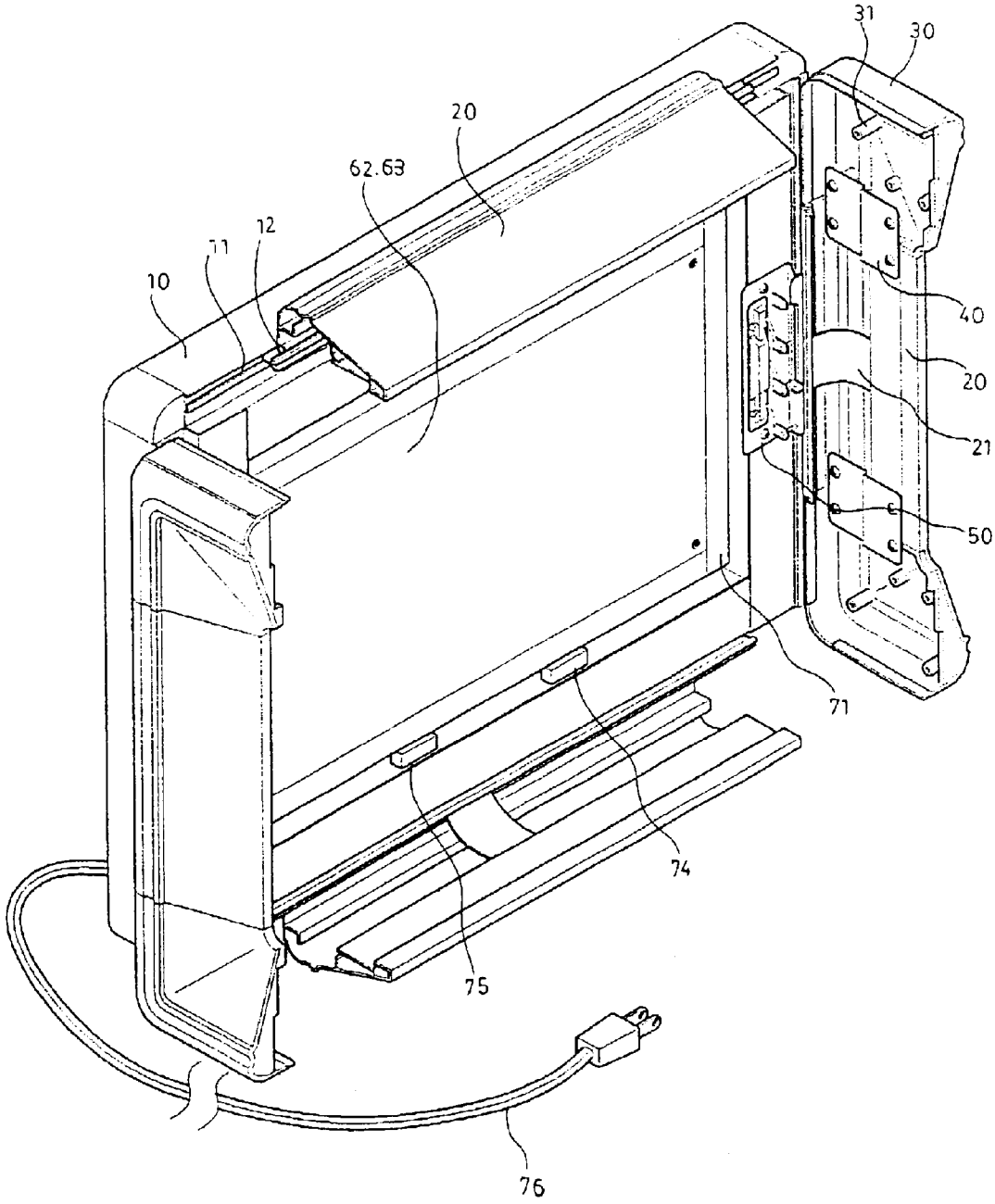
FIG. 2 is a schematic view showing the four lateral sides of the frame of the box which can be lifted up in accordance with the present invention.
Figure 3:
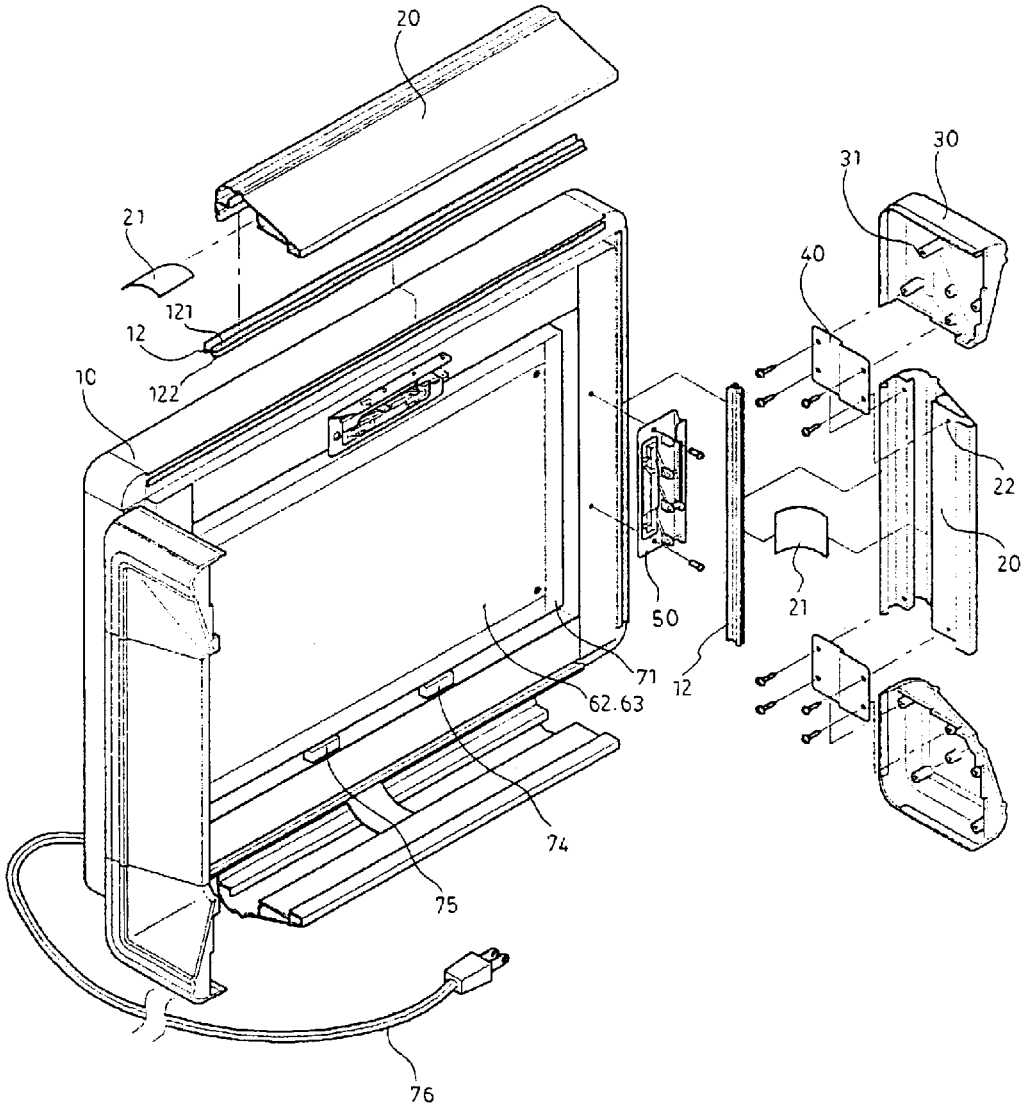
FIG. 3 is a perspective exploded view of the panel and the clip in accordance with the present invention.
Figure 4:
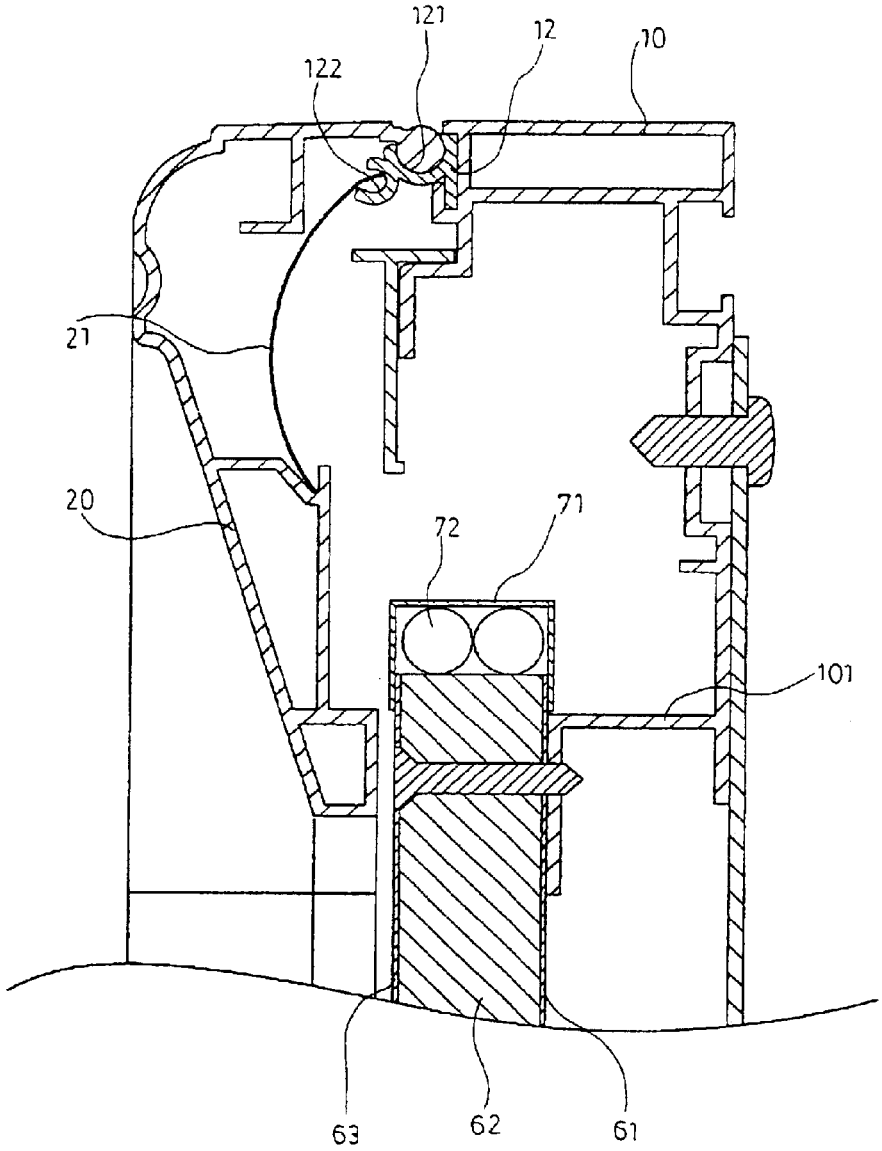
FIG. 4 is a partial sectional view of the advertisement light box of the present invention.
Figure 7:
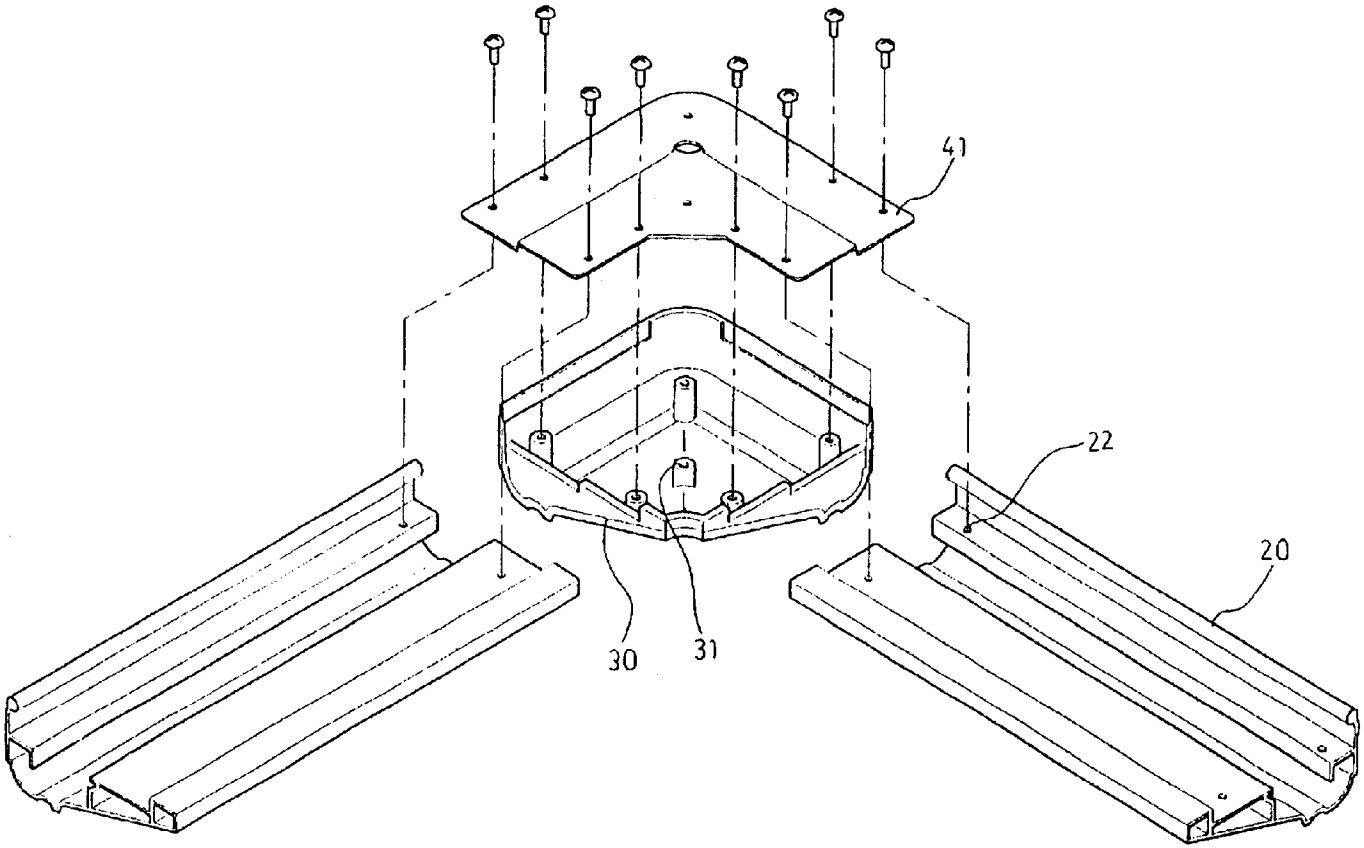
FIG. 7 is a schematic view of the L-shaped connection plate which can connect with the panel in accordance with the present invention.
Figure 8:
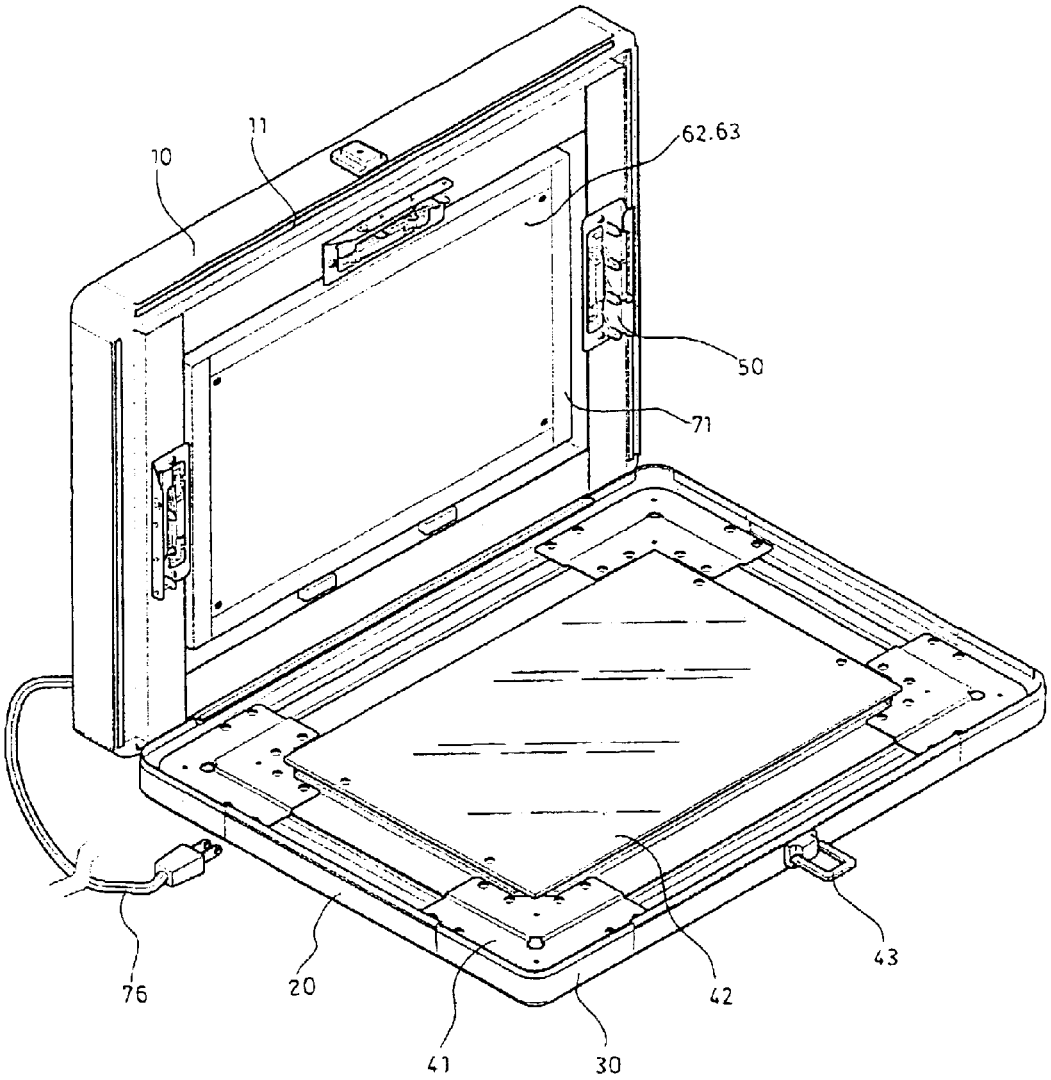
FIG. 8 is a schematic view showing the entire panel which can be lifted up in accordance with the present invention.
Figure 9:
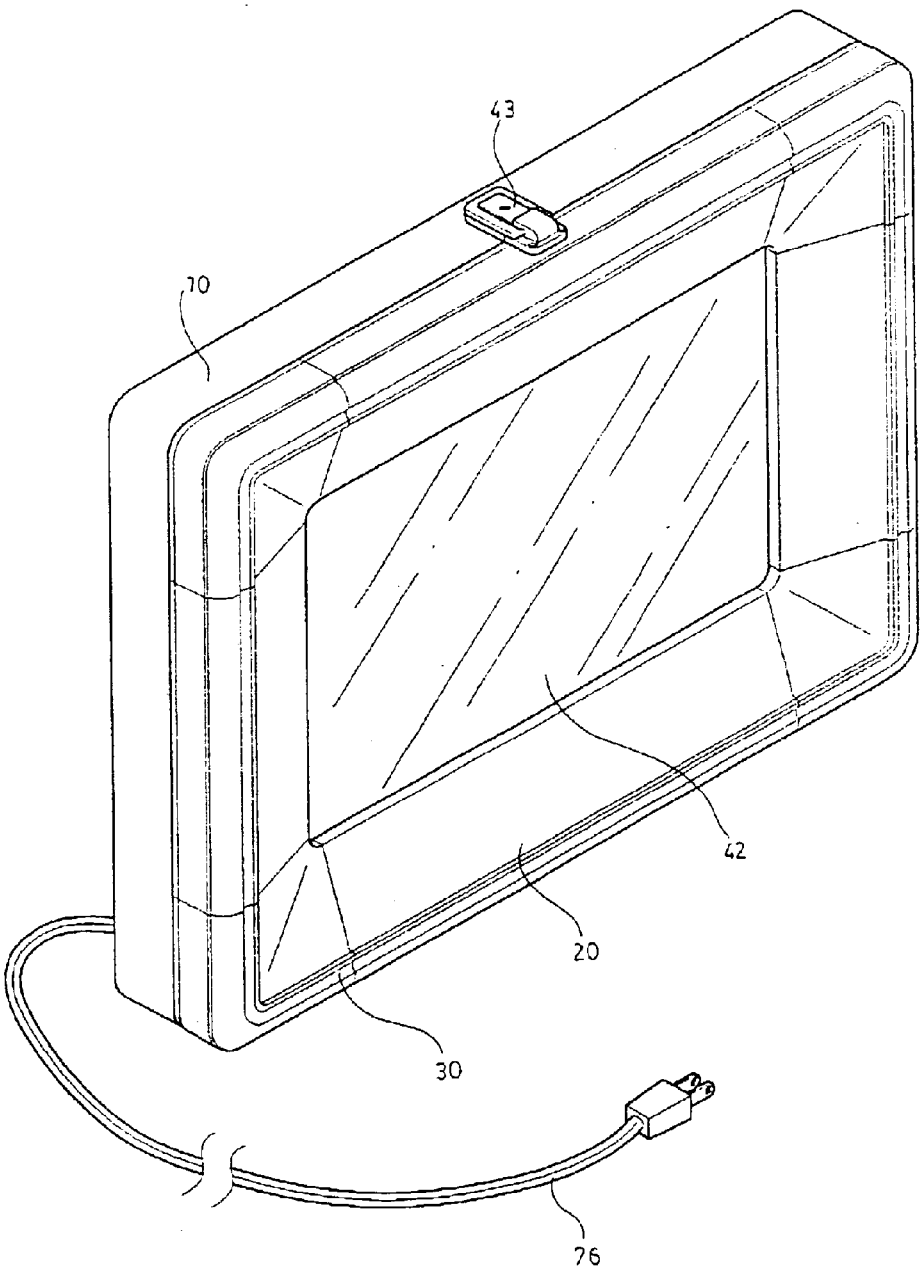
FIG. 9 is a schematic view showing the entire panel which can be lifted up in accordance with the present invention.

Referring to FIGS. 1, 2 and 3, there is shown an advertisement light box having a main frame 10 being provided with a guiding slot 11 at each of the four lateral sides thereof for the insertion of a pivotal shaft 12. One side of the pivotal shaft 12 is provided with a recessed side 121 such that one side of a panel 20 and a cornered panel 30 can be inserted and will not be dislocated. The other side of the pivotal shaft 12 is provided with a recessed edge 122 for the mounting of one end of an elastic plate 21, and the inner lateral side of the panel 20 is for the insertion of another end of the elastic plate 21. Thus the two ends of the elastic plate 21 are being urged and an appropriate elastic force is generated so that the panel 20 is a cover-like structure which can be lifted and is elastic. The inner lateral side of the panel 20 and the cornered panel 30 is provided with a plurality of locking holes 22, 31 such that the connection plate 40 mounted with screw fasteners can be fitted to the locking holes 22, 31. Due to the fact that the connection plate 40 can be mounted at the connection of the panel 20 and the cornered panel 30, the panels 20, 30 can be connected to form a four-sided panel which can be lifted. Referring to FIGS. 7, 8 and 9, if the entire panel is to be lifted, the pivotal shall 12 at three sides of the main frame 10 is withdrawn, and an L-shaped connection plate 41 connects each of the panel 20 and the cornered panel 30. By means of a screwing element, a transparent board 42 is locked to the panels 20, 30 to form a hollow frame. The opening area of the frame is mounted with a locker 43 to avoid inappropriate opening of the panel.

Figure 5:
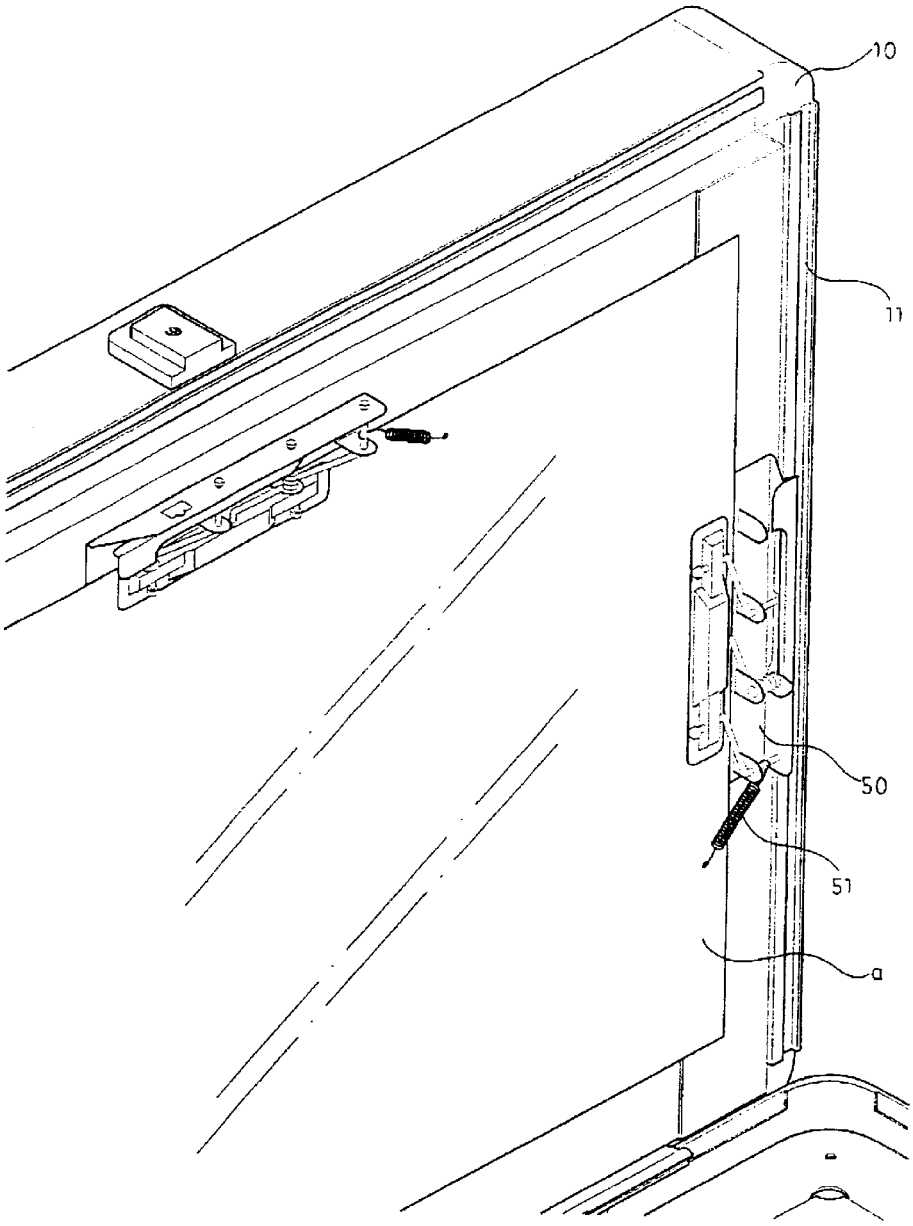
FIG. 5 is a perspective view showing the clip mounting an advertising material in accordance with the present invention.
Figure 6:
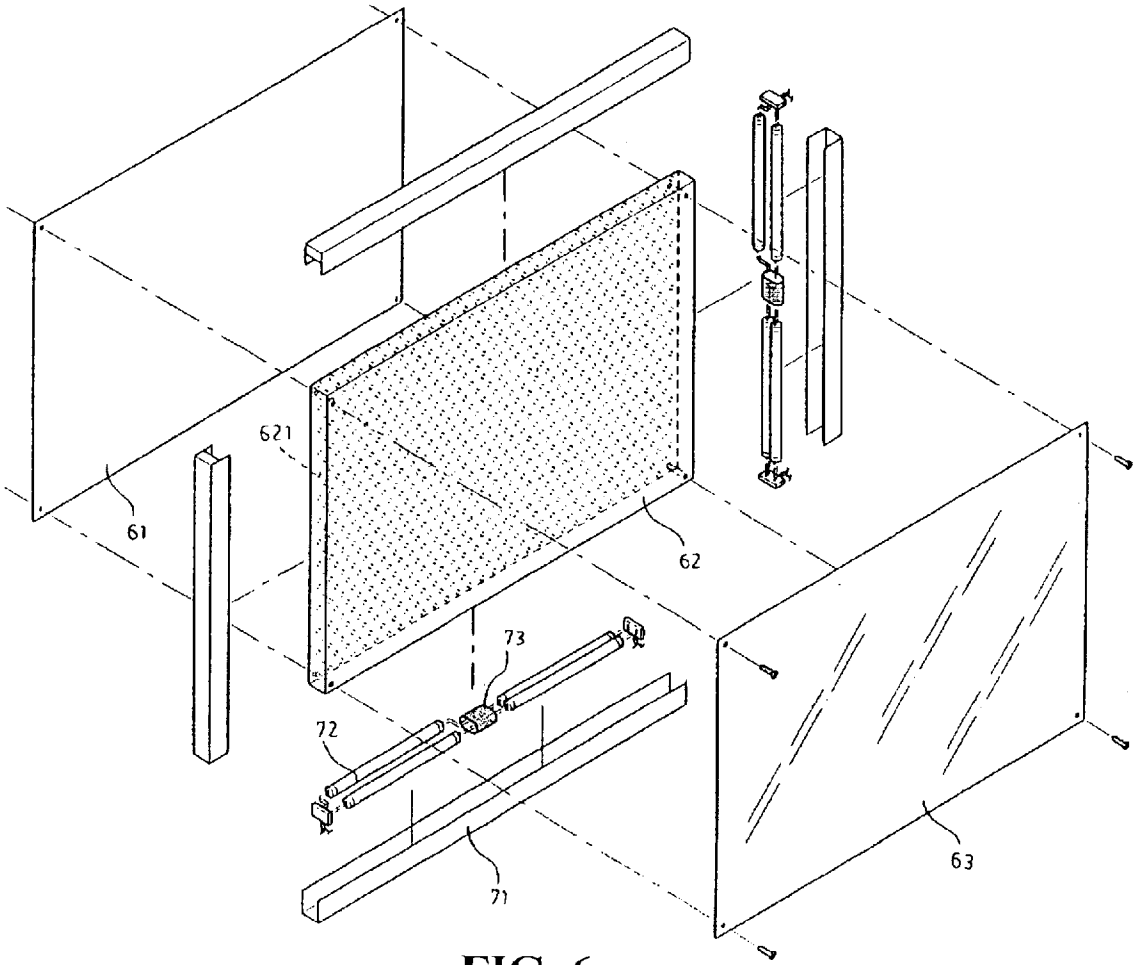
FIG. 6 is a perspective exploded view of the guiding light structure and the guiding light source in accordance with the present invention.

Referring to FIGS. 2, 3 and 5, the main frame 10 is disposed with a clip 50 so that an advertisement a can be easily mounted or dismantled. The number of the clips 50 depends on the wide and area thereof. If securing to the advertisement a is further required, an elastic hook 51 is provided to one end of the clipping body of the clip 50, and one end of the elastic hook 51 is hooked to the advertisement a.

Referring to FIGS. 2, 3, 4 and 6, the main frame 10 is provided with a light guiding structure and a light guiding positioning structure such that the light from the light source can be transmitted to the back of the advertisement a. The light guiding structure is mounted at the support 101 of the rear board of the main frame 10. Structurally, a light reflective board 61, a light guiding board 62 and a diffuser board 63 are mounted in sequence, and a screw mounts the boards 61, 62, 63 onto the support.

The light guiding source positioning device is positioned at the four lateral sides of the light guiding structure. The positioning device is an inverted U-shaped board 71 directly mounted to the side edge of the light guiding structure so as to prevent the light guiding board 62 from deformation as a result of beat but to provide securing or positioning function. The interior of the inverted U-shaped board 71 has an appropriate space to accommodate light tubes 72, and therefore the inverted U-shaped board provides a light focusing function. The number of the light tubes 72 can be increased or decreased depending on the area of the light guiding board 62 and the intensity of the guiding light causes the brightness of the light guiding board 62 to be evenly distributed and to prevent the light tubes from damages. As shown in the drawings, the thickness of the light guiding board 62 is 6 mm, the opening of the inverted U-shaped board 71 must be 6 mm and at this instance, the tube 72 has a diameter of 2–6 mm. Thus two tubes can be installed and the length of the tube 72 may be too long, the tube 72 can be connected by providing a connection which is covered by a soft rubber mounting 73. Thus, each lateral side of the light guiding structure is provided with four light tubes having an appropriate light guiding strength and the replacement of light tubes is simple. Further, the inner wall of the inverted U-shaped board 71 is electroplated with a silver surface or the like to provide an excellent light reflection effect.

Additionally the light guiding source positioning device is connected to a power source supplying device 74, a reverse use rectifier 75 for voltage stabilization, and conductive wires 76.

In view of the above, the present invention is a light box having four lateral sides which can be lifted or the entire panel can be lifted, and the advertisement can be easily removed or mounted. Additionally, the light guiding source positioning device is provided with positioning, focusing and light reflecting function so that maintenance of the advertisement light box is simple and the cost of maintenance is low.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An advertisement light box comprising a main frame having four lateral sides each having a guiding slot for insertion of a pivotal shaft, four panels, four cornered panels, and a light guiding structure, wherein one side of said pivotal shaft is provided with a recessed side engageable with one side of a respective one of said panels and one side of a respective one of said cornered panels, another side of said pivotal shaft is provided with a recessed edge for mounting of an end of an elastic plate, an inner lateral side of a respective one of said panels is engaged with another end of said elastic plate thereby causing two ends of said elastic plate to be urged and therefore providing said panels with a tendency to be sprung open, said panels being connected with said cornered panels by a connection plate, said main frame being provided with at least a clip for mounting an advertisement, said light guiding structure comprises a light reflective board, a light guiding board and a diffuser board mounted in sequence on a support of a rear board of said main name, four sides of said light guiding board are each engaged with an inverted U-shaped structure board, a plurality of light tubes are mounted within said inverted U-shaped structure board, and an inner wall of said inverted U-shaped board is electroplated with silver surface.

* * * * *